US005632118A

United States Patent [19]

Stark

[11] Patent Number: 5,632,118

[45] Date of Patent: May 27, 1997

[54] WINDOW TILT LOCK AND FRICTIONAL POSITIONER SHOE

[75] Inventor: Ivan Stark, Ada, Mich.

[73] Assignee: Newell Manufacturing Company, Lowell, Mich.

[21] Appl. No.: 551,565

[22] Filed: Nov. 1, 1995

[51] Int. Cl.[6] ..... E05D 15/22

[52] U.S. Cl. ..... 49/181; 49/183; 49/184

[58] Field of Search ..... 49/181, 183, 184, 49/161, 176, 179

[56] References Cited

U.S. PATENT DOCUMENTS

| | | | |
|---|---|---|---|
| 3,055,063 | 9/1962 | Peters . | |
| 3,108,335 | 10/1963 | Osten, Sr. . | |
| 3,108,393 | 10/1963 | Baker . | |
| 3,126,588 | 3/1964 | Osten, Sr. . | |
| 3,184,784 | 5/1965 | Peters . | |
| 3,349,518 | 10/1967 | Johnson . | |
| 3,434,237 | 3/1969 | Love . | |
| 3,482,354 | 12/1969 | Trout . | |
| 3,789,549 | 2/1974 | Yip . | |
| 4,364,199 | 12/1982 | Johnson et al. . | |
| 4,493,128 | 1/1985 | Corry . | |
| 4,718,194 | 1/1988 | FitzGibbon et al. | 49/181 |
| 4,914,861 | 4/1990 | May . | |
| 5,027,557 | 7/1991 | May . | |
| 5,127,192 | 7/1992 | Cross . | |
| 5,243,783 | 9/1993 | Schmidt et al. | 49/181 |
| 5,371,971 | 12/1994 | Prete | 49/181 |
| 5,377,384 | 1/1995 | Riegelman | 49/181 |

*Primary Examiner*—Kenneth J. Dorner
*Assistant Examiner*—Curtis Cohen
*Attorney, Agent, or Firm*—Price, Heneveld, Cooper, DeWitt & Litton

[57] ABSTRACT

An improved window assembly of the type having sliding, pivoting sashes, includes a window frame having a pair of jambs, a jamb liner secured to each of the jambs, a sash which is slidable within the jambs, and a frictional positioner shoe disposed within a channel in the jamb liner. The frictional positioner shoe provides frictional engagement between the sash and the jamb liners to securely hold the window in a raised position, and providing additional restraint against vertical movement of the shoe and rotational movement of the sash when it is tilted away from the plane of the window opening. Also provided is an improved window of the type having sliding, pivoting sashes, which include an elongate slidable member disposed within a channel in the jamb liner, and a rotatable member having an integrally attached brake member disposed within a bore passing through the elongate slidable member. The rotatable member has axial camming surfaces which engage complementary axial camming surfaces on the bore passing through the elongate slidable member. A pivot shaft connects the sash with the rotatable member, whereby rotation of the sash causes rotation of the rotatable member and engagement of the complementary camming surfaces, resulting in axial movement of the rotatable member toward and into engagement with a back wall of the channel.

17 Claims, 2 Drawing Sheets

WINDOW TILT LOCK AND FRICTIONAL POSITIONER SHOE

BACKGROUND OF THE INVENTION

This invention relates generally to a sliding sash window incorporating a frictional positioner shoe which is adapted to slide within a channel of a jamb liner mounted to a window jamb, while applying suitable friction to hold the sash in place at any selected raised position. More particularly, the invention relates to a frictional positioner shoe for a sliding, pivotable sash which includes a rotatable member connected to the sash to be rotated thereby and which moves axially when so rotated, in order to move a brake surface into engagement with a wall on the jamb liner and thus inhibit or retard vertical and rotational movement of the sash when it is tilted out of the plane of the window opening.

Several types of pivot shoe assemblies are known for pivotally mounting a window sash in its opening and for supporting the window sash at a desired height when the sash is tilted away from the plane of the window opening. Such known pivot shoe assemblies generally provide braking action only when the window sash is tilted out of the plane of the window and away from the jambs, and these do not provide any significant resistance or braking action against vertical movement of the window sash as it tracks along the jamb liners mounted to the jambs. Although such windows do generally incorporate a balance device such as a tension spring which counters the weight of the window sash to minimize the amount of force needed to raise and lower the window sash, such balance devices are not intended to, and do not usually restrain the window sash against vertical movement within the jambs. Typically, some additional positioning member is used for this purpose, for example a friction mechanism of some type, since few windows are so perfectly balanced (for example, one wherein the weight of the window sash is precisely countered by the tension of a balance tension spring) that they merely remain in their various different positions by themselves, or merely by whatever frictional contact exists between the jamb liner and the sash. Reliance on frictional contact between the jamb liner and sash to hold the sash in place once it has been raised can often lead to undesirable results wherein it becomes necessary to prop the sash up to keep the window open. Accordingly, a frictional positioning shoe which serves the dual function of providing increased restraint against rotational movement of the sash when it is tilted open such as for cleaning the outside of the windowpane, while also providing frictional resistance against vertical movement when the window sash is vertically raised within the plane of the window opening, is very desirable.

Another disadvantage with several of the known pivot shoe assemblies is that they are often comprised of many components, such as three or more components including a member which slides within a channel in a jamb liner, a rotatable barrel cam positioned within an opening in the slidable member, and a brake shoe which moves axially when the barrel cam is rotated. The complexity, number of manufacturing and assembly steps required during production, and hence the ultimate cost, of an article, such as a sliding, pivotable sash type window, generally increases when more components are used. It is therefore desirable to provide a frictional positioner shoe which facilitates pivotal mounting of a window sash and provides resistance against vertical and rotational movement of the sash when it is tilted away from the jambs, and which has fewer components to simplify manufacturing and assembly of sliding, pivotable sash type windows.

Many of the known pivot shoe assemblies include elements which are deformed or which cause deformation of the jamb liner when the window sash is pivoted. Deformation of the jamb liner, which is usually made of a material having a relatively low resilience such as rigid polyvinyl chloride, is particularly undesirable and can eventually lead to damage thereof. While the components of the pivot shoe have generally been made of a relatively stiffly resilient material such as nylon, repeated use and deformation of such a pivot shoe can eventually adversely affect the operating characteristic thereof. Accordingly, it would be even more desirable to provide a frictional positioner shoe for slidable, tiltable sash type windows which would provide restraint or braking action against vertical and rotational movement of the sash as it is swung away from the plane of the window opening, substantially without any significant distortion, deformation or damage to the positioner shoe or to the jamb liner.

SUMMARY OF THE INVENTION

The present invention overcomes the above mentioned disadvantages of known pivot shoe assemblies by providing a more reliable and more effective, as well as more efficient design, having fewer components. More specifically the invention provides a frictional positioner shoe for a slidable, pivotable sash type window having an elongate slidable member with front and back exterior walls which are urged toward and frictionally engage oppositely facing front and back interior walls of a channel within a jamb liner to restrain vertical movement of the window sash and hold the sash up without resort to extraneous means, and also having a rotatable member which is disposed within a through-bore in the shoe and moves axially when rotated to urge a brake surface against the wall of the jamb liner when the sash is rotated away from the jambs, out of the plane of the window opening, to inhibit or retard vertical and rotational movement thereof. Thus, an important advantage of the invention is the provision of a frictional positioning shoe which serves the dual braking functions of providing frictional contact with the jamb liner to securely hold the window in a raised position, and to more forcefully restrain vertical movement of the shoe as well as to retard or restrict rotational movement of the sash after it has been tilted away from the plane of the window opening.

Another important advantage of the invention is that the dual braking functions are achieved with a relatively simple mechanical arrangement. Specifically, the frictional positioner shoe comprises an elongate sliding member having a through-bore with camming surfaces which engage complementary camming surfaces on a rotatable member to cause axial movement of the rotatable member as it is rotated with the sash, whereby a braking surface on the rotatable member is extended outwardly from an exterior wall of the sliding member to engage an interior wall of a channel in the jamb liner.

A further advantage of the invention is the provision of a relatively rigid rotatable member having an integral surface member comprised of an elastomeric material which constitutes the braking surface of the rotatable member. The relatively rigid rotatable member insures positive engagement of the frictional surface with the channel wall of the jamb liner when the sash and rotatable member are rotated together to cause engagement of the complementary camming surfaces of the rotatable member and the sliding member, and resultant axial movement of the rotatable member. The elastomeric properties of the integral frictional surface member ensure the necessary degree of frictional contact with the channel wall of the jamb liner to provide very reliable positioning, without any significant or permanent distortion or damage of the channel wall or the frictional positioner shoe.

DETAILED DESCRIPTION OF THE PREFERRED EMBODIMENT

Figure 1:
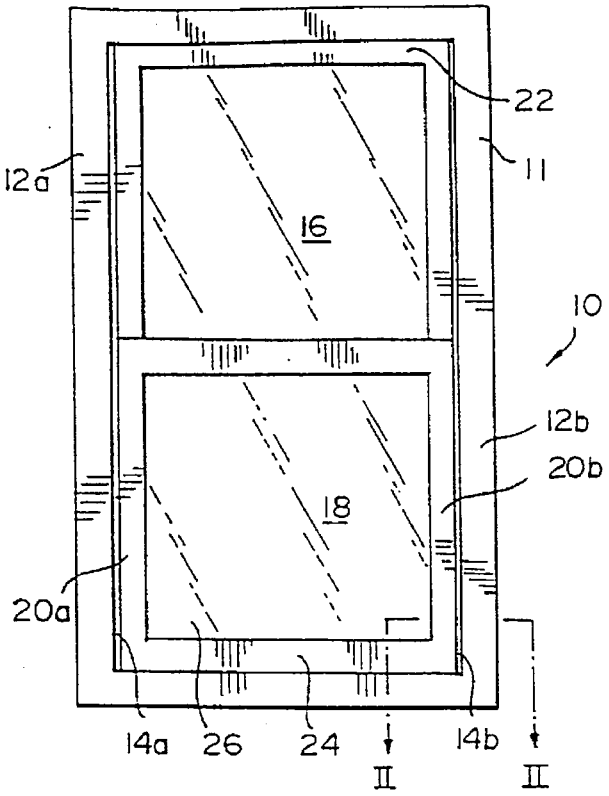
FIG. 1 is an elevational view of a slidable, pivotable sash type window incorporating the frictional positioner shoe and jamb liner of the invention.

Shown in FIG. 1 is a window 10 in which the frictional positioner shoe of the invention can be incorporated. The window 10 comprises a frame 11, including a pair of jambs 12*a*, 12*b*, a pair of jamb liners 14*a*, 14*b* which are fixedly secured to jambs 12*a*, 12*b*, respectively, and upper and lower sashes 16, 18, respectively, which are mounted for sliding vertical movement between jamb liners 14*a*, 14*b*. Sashes 16 and 18 each comprise side stiles 20*a*, 20*b*, top rail 22 and bottom rail 24 which frame a glass window pane 26.

The features of jamb 12*a*, jamb liner 14*a* and stile 20*a* are generally similar to, or substantially the same as, those of jamb 12*b*, jamb liner 14*b* and stile 20*b*, respectively; consequently, the jambs, jamb liners, stiles, and frictional positioner shoe will be described in detail with reference to the lower righthand portion of window 10 as shown in FIG. 1, the features of jamb 12*a*, jamb liner 14*a*, stile 20*a*, and the frictional positioner shoe associated therewith being apparent therefrom. Jamb liners 14*a* and 14*b* are preferably plastic extrusions having a constant cross-sectional profile, such as that shown in FIG. 2. Jamb liners 14*a*, 14*b* each include a pair of substantially identical channels 28*a*, 28*b* defined by back wall 30, opposite side walls 32, 33, and laterally spaced front wall portions 34, 35. The spacing between wall portions 34 and 35 defines an elongate vertical slot 36. Jamb liners 14*a*, 14*b* have a general facing or web level defined by central web portions 38, 39 and outer web portions 40, 41. Jamb liners 14*a*, 14*b* also include side walls 42, 43 and flange portions 44, 45 which extend outwardly from the base of side walls 42, 43, respectively. A portion of channels 28*a* and 28*b* extends beyond the general level of jamb liners 14*a*, 14*b* defined by webs 38, 39, 40, 41, toward stiles 20*a*, 20*b*. Stile 20*b* includes a plow or vertical groove 46 which extends along the height thereof. The portion of channels 28*a*, 28*b* which projects forwardly toward the window opening are closely or proximately received within groove 46 of stiles 20*a*, 20*b*, whereby sashes 16, 18 track vertically on jamb liners 14*a*, 14*b*. Closely or proximately received within each of the channels 28*a* and 28*b* is a frictional positioner shoe 50 which is slidable within the channels.

Jamb liners 14*a*, 14*b* can be secured to jambs 12*a*, 12*b* by stapling, tacking, nailing, or otherwise fastening flange portions 44, 45 to the flat surfaces jamb which face inwardly toward the window opening.

Figure 2:
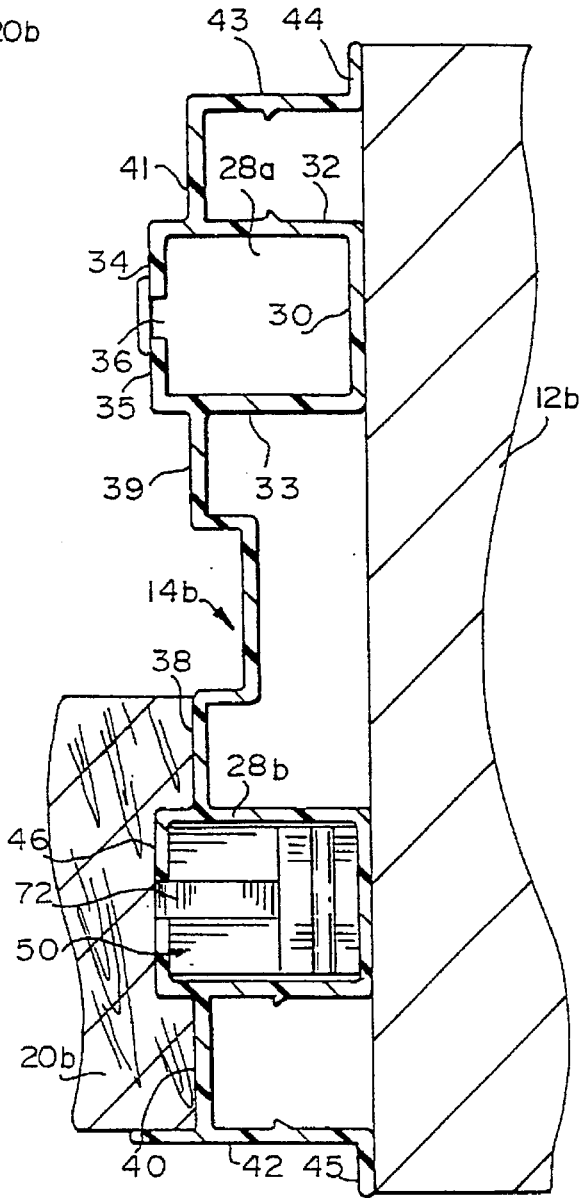
FIG. 2 is an enlarged fragmentary,cross-sectional view along the plane II—II of FIG. 1.
Figure 4:
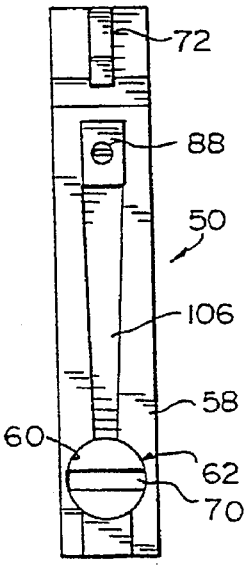
FIG. 4 is a front elevational view of the frictional positioner shoe.
Figure 5:
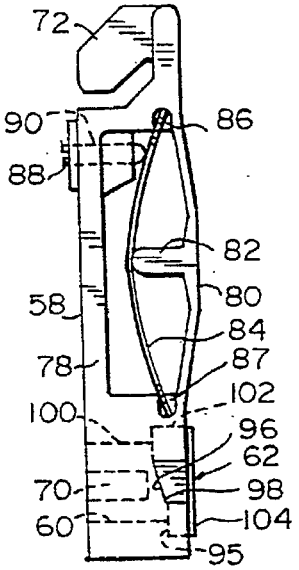
FIG. 5 is a side elevational view of the frictional positioner shoe.
Figure 6:
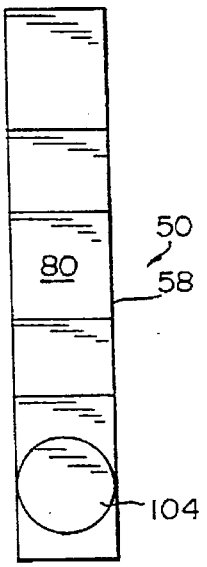
FIG. 6 is a rear elevational view of the frictional positioner shoe.

Frictional positioner shoe 50 comprises an elongate member having a substantially rectangular transverse cross-section as shown in FIG. 2. As shown in FIGS. 3–8, inclusive, elongate member 58 includes a cylindrical through-bore 60 in which is received a rotatable member 62. Sashes 16, 18 are pivotally connected to frictional positioner shoes 50 by means of a rigid connector 64 (FIG. 3) having a foot portion 66 adapted to be mounted to the underside of the stiles 20*a*, 20*b* and a pivot shaft 68 which is adapted to be received within a keyway 70 in rotatable member 62. Connector 64, and thus pivot shaft 68, is secured to sashes 16, 18 in fixed relationship thereto so that rotation of each of the sashes 16, 18 also rotates its respective pivot shaft 68 about an axis of rotation coincident with the central longitudinal axis of through-bore 60 and rotatable member 62 received therein. The positive engagement between pivot shaft 68 and keyway 70 insures that rotation of sashes 16 or 18 is positively transmitted to rotatable member 62. As is best illustrated in FIGS. 4 and 5, elongate member 58 includes a hook portion 72 over which the lower end 74 of a sash balancing tension spring 76 is looped. The upper end (not shown) of sash balance tension spring 76 is connected to a stationary portion of the window such as an upper portion of frame 11 or jamb liners 14*a*, 14*b* in a conventional manner to counter the weight of sashes 16, 18, so that they can be raised and lowered with a minimum amount of effort. Frictional positioner shoe 50 includes a front wall 78, a rear wall 80, and a substantially hollow region interposed between walls 78 and 80. Projecting inwardly toward the substantially hollow region between walls 78 and 80 is a rib 82 which extends toward front wall 78 from rear wall 80. A leaf spring 84 is flexed over rib 82 into a bow shape with the ends of the spring being supported at opposite ends in upper and lower pockets 86 and 87. The bias of spring 84 can be adjusted by rotating an adjustment screw 88 within a threaded aperture 90. Spring 84, through rib 82, urges rear wall 80 away from front wall 78. Accordingly, the amount of frictional contact between front wall 78 of frictional positioner shoe 50 and the interior side of front wall portion 34 and 35 of channels 28*a*, 28*b*, and between rear wall 80 of frictional positioner shoe 50 and back wall 30 of channels 28*a*, 28*b* can be adjusted as needed or desired to hold sashes 16, 18 in any desired raised position, without imposing excessive frictional resistance which would make it difficult to raise or lower sashes 16, 18.

Elongate member 58 is preferably provided with an elongate vertical recess 106 (FIGS. 3 and 4) for facilitating removal of sashes 16, 18 from the jamb liners 14*a*, 14*b*, and from the window opening after the sash have been tilted and the elongate members 50 locked in place. That is when sashes 16, 18 are tilted 90 degrees or thereabouts from the plane of the window, keyway 70 becomes aligned with recess 106, whereby pivot shaft 68 can more readily be slid out of keyway 70 and through recess 106 to permit easy sash removal.

Figure 7:
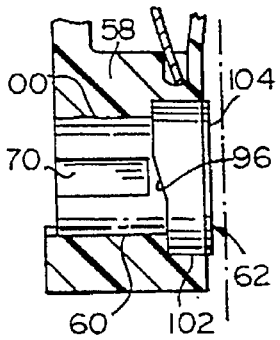
FIG. 7 is an enlarged fragmentary, side-elevational view of the frictional positioner shoe showing the same in its normal operating configuration.
Figure 8:
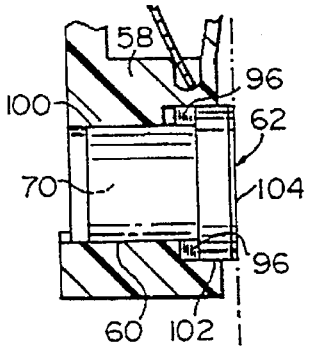
FIG. 8 is an enlarged fragmentary, side-elevational view of the frictional positioner shoe showing the same in its sash-locking configuration.
Figure 3:
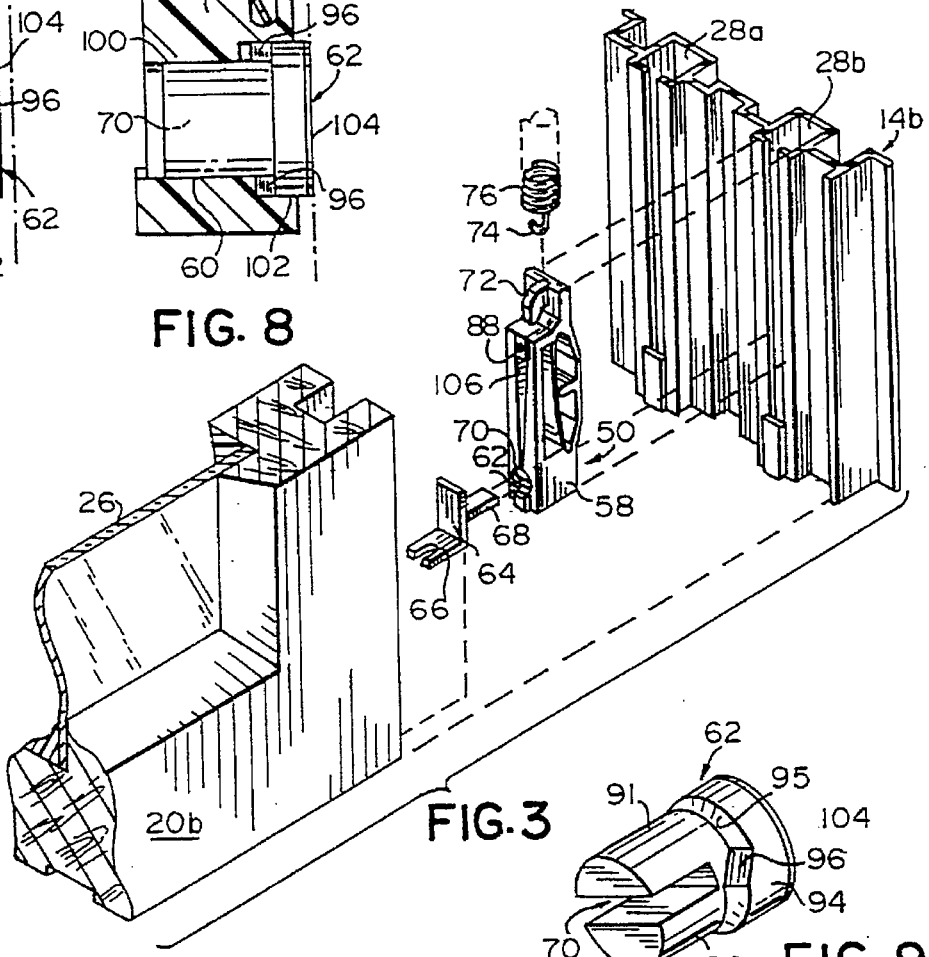
FIG. 3 is a fragmentary, perspective, exploded view of the sash, friction shoe, and jamb liner.
Figure 9:
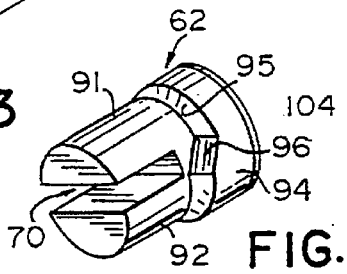
FIG. 9 is a perspective view of the rotatable braking member of the frictional positioner shoe.

Rotatable member 62 (FIG. 9) includes a slotted shank comprising spaced apart shank portions 91, 92 which define keyway 70, and a head portion 94. The underside 95 of head portion 94 includes an angular camming surface 96 which mates with a complementary radial camming surface 98 (FIG. 5) on the peripheral shoulder formed between a reduced diameter cylindrical portion 100 and an enlarged diameter counter-bore portion 102 of through-bore 60. When sash 16 or 18 is tilted or pivoted out of the plane of the window opening, pivot shaft 68 acts upon keyway 70 to rotate the rotatable member 62, thereby sliding the mating radial camming surfaces 96, 98 upon one another and causing axial movement of member 62 toward the jamb liners 14*a*, 14*b*. This in turn forces braking surface or braking member 104 against back wall 30 of the jamb liners. FIG. 7 illustrates the position of rotatable member 62 relative to sliding member 58 when the sash is in its normal position within the plane of the window opening, and FIG. 8 shows member 62 axially translated toward back wall 30 of jamb liner 14*a*, 14*b*, with braking member 104 in contact with rear channel wall 30, when the sash is tilted out of the plane of the window opening and toward the interior of the building, for cleaning or the like.

Braking surface 104 can be an integral part of member 62, in which case member 62 is of one-piece construction and made of a material having a non-lubricous surface characteristic, or with the braking surface 104 made rough. More preferably, rotatable member 62 and brake member 104 are integrally formed of different materials which are fused together. Specifically, it is considered desirable to form both the elongate sliding member 50 and rotatable member 62 of a tough, stiffly resilient polymeric material such as glass-filled polypropylene, whereas brake member 104 most preferably comprises a thin layer of an elastomeric polymer such as synthetic or natural rubber, to provide good frictional contact, and resultant positive braking operation between the end surface of rotatable member 62 and the adjacent jamb liner surface, while also precluding any significant distortion or damage of the channel wall or frictional positioner shoe. In this most preferred configuration, rotatable member 62 and brake member 104 are conjointly formed, as by co-molding.

More particularly, brake member 104 can be molded with rotatable member 62 using a mold with a retractable core and two injection molding machines. With the core in the forward position, the cavity is filled from the first molding machine with a tough, stiffly resilient polymeric material such as glass-filled polypropylene to form member 62. The core used to form the face of brake member 104 is then retracted by a distance equal to the desired thickness of the brake member, and the resulting cavity filled with the elastomeric polymer which forms the brake member. The two polymeric materials used in this manner to form rotatable member 62 and brake member 104 should thus be chemically compatible so that the materials will fuse or otherwise bond or adhere tightly together. Bonding can be further enhanced if needed by roughening the surface of the mold which forms the bonding surface of member 62. An alternative method for securely mounting brake member 104 on rotatable member 62 is by forming member 62 in a first mold, inserting the formed member 62 into a second mold having a cavity volume equal to the total volume of rotatable member 62 and brake member 104, and molding the elastomeric polymer onto the rotatable member in the second cavity.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

The embodiments of the invention in which an exclusive property or privilege is claimed are defined as follows:

1. A window having a sliding, pivoting sash, comprising:

a window frame defining a window opening plane, said frame including a pair of jambs at opposite sides thereof;

a jamb liner secured to each of said jambs, each of said jamb liners including a channel;

a sash slidable within said jambs;

a frictional positioner shoe including an elongate slidable member disposed within said channel;

a rotatable member disposed within a bore passing through said elongate slidable member, said bore including a larger diameter portion adjacent said jamb, a smaller diameter portion adjacent said sash, and a shoulder defined at the juncture between said larger and smaller bore portions, said shoulder defining an axial camming surface, said rotatable member including a smaller diameter portion received in said smaller diameter portion of said bore, a larger diameter portion of said rotatable member received in said larger diameter portion of said bore, and a shoulder defined at the juncture between said larger and smaller portions of said rotatable member, said shoulder of said rotatable member defining a complementary axial camming surface which engages said axial camming surface of said bore, said rotatable member including a keyway which opens towards said sash;

a pivot shaft projecting from said sash and engaging said keyway to connect said sash to said rotatable member, whereby rotation of said sash out of the plane of the window opening causes rotation of said rotatable member and engagement of said axial camming surface, which results in axial movement of said rotatable member toward and into engagement with a back wall of said channel to provide restraint against vertical movement, and to retard rotational movement, of said sash as it is tilted away from the plane of said window; and a brake member comprised of an elastomeric polymer integrally secured to said rotatable member for engagement with said back wall of said channel when said sash is pivoted out of the plane of the window opening.

2. The window of claim 1, wherein said brake member is comprised of rubber.

3. The window of claim 2, wherein said elongate slidable member includes opposite walls which are resiliently urged against and frictionally engage opposite walls of said channel, said opposite walls of said elongate slidable member being resiliently urged against said opposite walls of said channel by a spring.

4. The window of claim 3, wherein said elongate member and said rotatable member are comprised of a stiffly resilient polymeric material.

5. The window of claim 4, wherein said stiffly resilient polymeric material is nylon.

6. The window of claim 3, wherein said spring is a leaf spring.

7. The window of claim 3, wherein the bias of said spring can be adjusted by rotating an adjustment screw disposed on said frictional positioner shoe.

8. The window of claim 1, wherein said elongate slidable member includes a hook at the upper portion thereof, and a sash balance tension spring which is connected at one end to said hook and at another end to a stationary portion of said window to counter the weight of said sash, whereby an amount of force needed to slide the sash vertically within said jambs is minimized.

9. A window having a sliding, pivoting sash, comprising:

a window frame including a pair of jambs on opposite sides thereof, said frame defining a window opening plane;

a jamb liner secured to each of said jambs, each of said jamb liners including a web which is generally parallel with said jamb and a channel which projects rearwardly from said web towards said jamb and forwardly from said web away from said jamb, said channel including a back wall, a pair of side walls and laterally spaced front wall portions, said spaced front wall portions defining an elongate vertical slot;

a sash slidable within said jamb, said sash having opposite side stiles, each of said stiles having a plow into which the forwardly projecting portion of said channel is proximately received;

a frictional positioner shoe including an elongate slidable member disposed within said channel, said elongate member having opposing front and back walls which are resiliently urged against and frictionally engage said back wall and front wall portions of said channel;

a rotatable member disposed within a bore passing through said elongate slidable member, said bore including a larger diameter portion adjacent said jamb, a smaller diameter portion adjacent said sash, and a shoulder defined at the juncture between said larger and smaller bore portions, said shoulder defining an axial camming surface, said rotatable member including a smaller diameter portion received in said smaller diameter portion of said bore, a larger diameter portion of said rotatable member received in said larger diameter portion of said bore, and a shoulder defined at the juncture between said larger and smaller portions of said rotatable member, said shoulder of said rotatable member defining a complementary axial camming surface which engages said axial camming surface of said bore, said rotatable member including a keyway which opens towards said sash; and a pivot shaft projecting from said sash and engaging said keyway to connect said sash to said rotatable member, whereby rotation of said sash out of the plane of the window opening causes rotation of said rotatable member and engagement of said complementary axial camming surfaces, which results in axial movement of said rotatable member toward and into engagement with said back wall of said channel to provide resistance against vertical movement, and to retard rotational movement, of said sash as it is tilted away from the plane of the window.

10. The window of claim 9, further comprising a brake member composed of an elastomeric polymer, said brake member being integrally secured to said rotatable member for engagement with said back wall of said channel when said sash is pivoted out of the plane of the window opening.

11. The window of claim 10, wherein said brake member is comprised of synthetic or natural rubber.

12. The window of claim 11, wherein said elongate member and said rotatable member are comprised of a stiffly resilient polymeric material.

13. The window of claim 12, wherein said stiffly resilient polymeric material is glass-filled polypropylene.

14. The window of claim 10 wherein said opposite walls of said elongate slidable member are resiliently urged against said opposite walls of said channel by a spring.

15. The window of claim 14, wherein said spring is a leaf spring.

16. The window of claim 15, wherein the bias of said spring can be adjusted by rotating an adjustment screw disposed on said frictional positioner shoe.

17. The window of claim 16, wherein said elongate slidable member includes a hook at the upper portion thereof, and a sash balance tension spring connected at one end to said hook and at another end to a stationary portion of said window to counter the weight of said sash, whereby an amount of force needed to slide the sash vertically within said jambs is minimized.

* * * * *